United States Patent [19]

Neefe

[11] Patent Number: 4,472,260

[45] **Date of Patent: * Sep. 18, 1984**

[54] LIGHT DRIVEN HYDROGEN OXYGEN GENERATOR

[76] Inventor: Charles W. Neefe, 811 Scurry St., Box 429, Big Spring, Tex. 79720

[ * ] Notice: The portion of the term of this patent subsequent to May 19, 1998 has been disclaimed.

[21] Appl. No.: 440,080

[22] Filed: Dec. 23, 1982

[51] Int. Cl.[3] ..... C25B 9/00; C25B 1/04; H01M 6/34

[52] U.S. Cl. ..... 204/278; 204/129; 204/242; 204/157.1 R; 429/111

[58] Field of Search ..... 429/111; 204/242, 129, 204/278, 157.1 W; 351/160 R, 160 H

[56] References Cited

U.S. PATENT DOCUMENTS

| | | | |
|---|---|---|---|
| 4,021,323 | 5/1977 | Kilby et al. | 204/129 |
| 4,268,132 | 5/1981 | Neefe | 351/160 H |
| 4,357,400 | 11/1982 | Appleby | 429/111 |
| 4,401,371 | 8/1983 | Neefe | 351/160 R |

*Primary Examiner*—Howard S. Williams
*Assistant Examiner*—T. L. Williams

[57] ABSTRACT

A light driven hydrogen oxygen generator in which a hydrogel coating is polymerized over photoreceptors allowing the electrolyte to reach the surface of the photoreceptor and protect the photoreceptor from contamination by impurities which may be present in the electrolyte. The surface of the hydrogel also rejects the accumulation of debris to maintain its permeability.

3 Claims, 2 Drawing Figures

LIGHT DRIVEN HYDROGEN OXYGEN GENERATOR

THE PRIOR ART

The production of hydrogen for use as a fuel is receiving world wide attention. The most desirable approach is the conversion of water to hydrogen and oxygen by use of sunlight. The process encounters many problems, one which we are solving here is the accumulation of debris from the water on the surface of the photo receptors.

STATE OF THE ART

Natural photosynthesis provides the most obvious example of photochemical solar energy conversion. Field efficiency (yearly average, best crops and so on) is about 1%. These figures are not so high as the efficiency for electricity generation by solid-state photovoltaics. Sunlight-induced photoelectrolysis conversion of water to hydrogen and oxygen approaches the field efficiency of natural photosynthesis. Solid-state photovoltaic devices are the only man-made systems having any wide spread use for solar energy conversion based on electronic excitations. Solid/liquid junction devices represent the best chemical systems for converting light to hydrogen and oxygen from water. The most impressive systems for solar energy conversion to electricity and production of oxygen from water involve the interfacial photoredox events at the junction between semiconductors and liquid electrolyte solutions. Semiconductor/-liquid junction cells are different from photogalvanic cells in that light is absorbed by a solid electrode, not by electrolyte species in solution. The most efficient system for the photoelectrolysis of water is the strontium titanium trioxide based cell. The overall efficiency of converting solar energy to hydrogen and oxygen is about 1%. N-type titanium dioxide/p-type gallium phosphorus based cells produce hydrogen and oxygen with no other energy input than the light striking the two electrodes. This type of observation led to the conclusion that "photochemical diodes" consisting of aqueous suspensions of n-type titanium dioxide/p-type gallium phosphorus particles can yield hydrogen and oxygen from water on optical excitation. Another approach is to sensitize stable semiconductors using visible-light absorbing dyes attached to the surface. In this approach the aim is to absorb light by a dye layer on the semiconductor surface to produce an excited state; this has been achieved by using zinc oxide sensitized with rose bengal.

Figure 2:
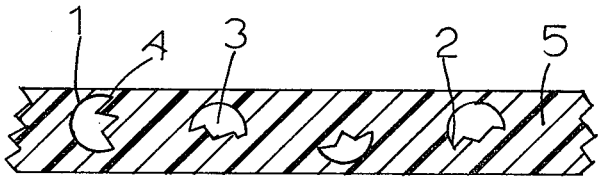
FIG. 2 shows the photosensitive particle imbedded in the hydrogel.

The carrier of material 5 FIG. 2 may be any hydrophilic water containing material. Examples of carrier materials are poly hydroxypropyl methacrylate, and hydratable polymethylmethacrylate hydroxyethyl methacrylate.

Photosensitive particles are suspended in the monomers and a suitable catalyst is added to achieve polymerization. The photosensitive particles are selected from titanium dioxide combined with gallius phosphorus; platinum combined with strontium titanium trioxide, tin oxide combined with a dye; or zinc oxide combined with rose bengal dye. Ferric oxide, titanium dioxide, tin oxide and zinc oxide photoanodes may be used in combination with a nobel metal such as platinum. After polymerization, the transparent polymer containing the photosensitive particles imbedded in the polymer machined into the photosensitive particles. After hydration in the electrolyte the liquid semiconductor junction is established at the photosensitive interface and hydrogen and oxygen will be released by the electrolysis of water upon exposure to sunlight.

Procedures have been developed for making polymers having sulfonate groups exposed at the surface. In general these procedures involve forming a sulfonate containing copolymers then adding a chemical agent that creates crosslinks among the long-chain molecules.

When the sulfonates were tested with conditions that usually cause severe buildup of debris, the results proved to be remarkable.

Polymers incorporating in their structure the sulfonate group, gives them an extreme affinity for water and thereby prevents most foreign matter from adhering. Most debris particles are hydrophobic, or in other words, repel water; most of them also bear a negative electric charge. The most serious debris problems are caused by materials such as oily particles and proteins, which have large surface areas that are hydrophobic, or in other words, repel water. When a hydrophobic substance is in an aqueous environment, it can reduce its total energy by reducing the area exposed to the water; two hydrophobic particles, tend to clump together expelling the water from the space between them and thereby reducing the water from the space between them and thereby reducing their exposed surface. This phenomena is called hydrophobic bonding. In the same way such a particle can be held to the surface by the elimination of repulsive interactions with the surrounding water. Most of the debris materials also bear a negative electric charge, and hydrogen bonding involving these charges also contribute to the buildup of debris. In this kind of bonding the slight positive charge of a hydrogen atom at the surface attracts a negatively charged group in the debris particle.

One obvious way to avoid hydrophobic interactions is to create a surface that is hydrophilic, one that has a very strong affinity for water. Such a material remains wetted even in the presence of hydrophobic particles, so that the particles cannot adhere to the surface by excluding water.

The most hydrophilic known polymers are those bearing on their surface the sulfonate group, $SO_3$. Like the sulfuric acid from which they were derived, sulfate polymers have a strong affinity for water. Each sulfonate group is surrounded by many water molecules, which cannot be displaced by hydrophobic particles. The sulfonate group is also incapable of hydrogen bonding; indeed, its negative charge repels the negatively charged debris particles. The negative charge of the sulfonate is also maintained even in the presence of a large concentration of hydrogen ions. Moreover, the sulfonate group resists deactivation by positive ions, such as those of the heavy metals.

In additions to providing resistance to debris, the fixed charges of the sulfonate groups confer another property: the enhanced rejection of salts. Unchanged surfaces, have only limited ability to exclude salts, which exist in solution as negative and positive ions. In the sulfonates, however, the fixed negative charges generate an electric field that repels ions of the same charge and thereby exculdes them from the surface. Since the electrical neutrality of the solution must be maintained positive ions are also blocked.

In liquid water about half the molecules at any moment are in clusters that have the same orderly structure as a crystal of ice. In the clusters each water molecule is placed so that the oxygen atom occupies the vertex of a tetrahedron and so that a hydrogen bond connects each pair of water molecules. In ice, this stable structure extends over a long distance, but in the liquid state the icelike clusters generally include only a few molecules each, and they are constantly forming and disintegrating. Inside the structure of a negative charged hydrogel the water assumes an icelike state, in which the molecules have an orderly arrangement and are held together by hydrogen bonds. The geometry of the icelike state is tetrahedral, with each oxygen atom surrounded by four others at equal distances. Other molecules and particles are rejected, including not only those that are too large to fit through the membrane but also small molecules that cannot conform to the icelike structure. Ions in particular are excluded because they are shielded by a layer of water that would disrupt the icelike lattice.

Sulfur and phosphorus containing polymers have been found to exhibit the highest degree of hydrophilicity with the sulfonates being the most hydrophilic. The monomers may be selected from the following or other similar monomers:

1. Allyl Disulfide
Allylethylsulfide
3. Allyl Methyl Sulfide
4. Allylphenyl Sulfide
5. Allyl n-Propyl Sulfide
6. Allyl iso-Propyl Sulfide
7. Diallyl Phosphite
8. Diallyl Disulfide
9. Diallyl Sulfide
10. Divnyl Sulfone
11. Ethylene Sulfide
12. Sodium Allyl Sulfonate
13. Sodium p-Styrene Sulfonate
14. Vinyl Sulfonate, Sodium Salt
15. Vinyl Sulfonic Acid
16. Styrene Sulfonic Acid
17. Diallylallyl Phosphonate
18. Diallyl Phosphite
19. beta-Styrene Sulfonate
20. Triallyl Phosphate
21. Vinyl Methyl Sulfide
22. Vinyl Triphenylphosphonium Bromide
23. Vinyl Ethyl Sulfone
24. Sodium Styrene Sulfonate Copolymers are formed by polymerizing the above sulfur and phosphorus monomer with one or more of the following examples:

1. Methylmethacrylate and methacrylic acid
2. Ethylene Glycol Monomethylacrylate
3. Hydroxypropyl Methacrylate Crosslinkers may be selected from one or more of the following examples:

1. Diglycol Carbonate
2. Allyl Methacrylate
3. Tetraethylene Glycol Dimethacrylate
4. Ethylene Dimethacrylate
5. Divinyl Benzene
6. Vinyl Crotonate The liquid solid junction is made with the electrolyte contained within the matrix of the polymer material. This provides unique conditions of self regulation and supplying a permanent contamination free liquid to solid interface. These properties separate or together offer many improvements in other applications of solar energy. Self regulation occurs when $O_2$ or $H_2$ are produced at a rate greater than the migration rate into the polymer matrix away from the reaction site where the gases are formed. When undissolved gas accumulates on the surface of the reaction site; the water is displaced and further gas production stops until the gas dissolves or is free to migrate.

DESCRIPTION OF THE PREFERRED EMBODIMENT

Figure 1:
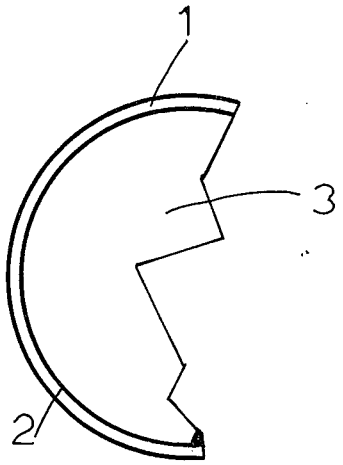
FIG. 1 shows a photosensitive particle in section.

Photosensitive particles are formed from by coating strontium titanium trioxide pellets, 3 FIGS. 1 and 2, with platinum, 1 FIGS. 1 and 2, and breaking the pellets between metal rollers. The fractured particles are then mixed with the monomer hydroxyethyl methacrylate, 2% of the crosslinkers ethylene dimethylacrylate and 0.25% of the catalyst 2, $2^1$ Azobis (2 methylpropionitrite) purged of oxygen, placed under a nitrogen blanket and heated to 55° C. for twelve hours and post cured for 8 hours at 70° C. When exposed to light, an electric potential will be present across the junction, 2 FIGS. 1 and 2, and oxygen, 4 FIG. 2 will be released from the strontium titanium trioxide surface. The water present within the hydrophilic material acts as the required electrolyte and as a reservoir for the dissolved oxygen.

Various modifications, of course, can be made without departing from the spirit of this invention or the scope of the appended claims. It is understood that many variations are obtainable which will yield results as disclosed herein. The constants set forth in this disclosure are given as examples and are in no way final or binding.

I claim:

1. A light driven hydrogen and oxygen generator having a plurality of light absorbing semiconductor receptors imbedded within a hydrogel, said light receptors being capable of producing an electrical current when activated by light, and providing hydrogen and oxygen by the decomposition of water by electrolysis.

2. A light powered hydrogen and oxygen generator composed of a transparent hydrogel having light absorbing semiconductor receptors imbedded within the hydrogel, said light receptors being capable of producing an electrical current when energized by light and providing hydrogen and oxygen by the decomposition of water by electrolysis.

3. A hydrogen and oxygen generator having light receptors imbedded in a protective hydrogel whereby impurities and debris which may be present outside the hydrogel do not come in contact with the protected light receptors.

* * * * *